United States Patent [19]

Bahout et al.

[11] 4,079,184

[45] Mar. 14, 1978

[54] FURNACE WALL ELEMENT

[75] Inventors: Bernard Bahout, Lorry-les-Metz; Jean-Pierre Motte; Pierre Vayssiere, both of Metz, all of France

[73] Assignee: Institut de Recherches de la Siderurgie Francaise (IRSID), Saint Germain-en-Laye, France

[21] Appl. No.: 714,756

[22] Filed: Aug. 16, 1976

[30] Foreign Application Priority Data

Aug. 28, 1975 France ..... 75 26573

[51] Int. Cl.[2] ..... F27D 1/12

[52] U.S. Cl. ..... 13/32; 266/280; 13/35

[58] Field of Search ..... 13/32, 35; 266/280, 266/283, 286

[56] References Cited

U.S. PATENT DOCUMENTS 3,692,103 9/1972 Andoniev et al. ..... 13/32 UX 3,829,595 8/1974 Nanjyo et al. ..... 13/32

3,843,106 10/1974 Nanjyo et al. ..... 13/32 X

*Primary Examiner*—R. N. Envall, Jr.

*Attorney, Agent, or Firm*—Kurt Kelman

[57] ABSTRACT

A wall element for furnaces useful in all types of metallurgical furnaces but particularly in electric arc steel refining furnaces is comprised of a metallic block defining a cooling circuit in the interior thereof and a lining of refractory bricks anchored firmly to the cooled metallic block. The metallic block carries anchoring lugs projecting from the internal face of the block, each lug consisting of a foot portion and a retaining portion, which is constituted by an enlarged end of the foot portion opposite the internal face. Each refractory brick has a face adjacent the internal face of the metallic block and defining a recessed portion of a cross section matching that of a corresponding one of the anchoring lugs.

11 Claims, 5 Drawing Figures

FURNACE WALL ELEMENT

The present invention relates to wall elements for metallurgical furnaces, particularly useful for electric arc steel refining furnaces.

The present tendency is to employ very high power in electric steel refining furnaces to increase the productivity. As the temperatures increase, the refractory linings of such furnace walls are ever more rapidly worn. Particularly those zones located above the slag and subjected to the radiation of the electric arc constitute hot points which must be protected. One solution to this problem consists of placing cooling blocks at these hot points, such as metallic blocks defining a cooling circuit in the interior thereof and whose internal faces have recessed portions designed to receive refractory bricks of matching size. The spaces between adjacent rows of arrayed bricks are faced with refractory material either tamped or cast into these spaces. This produces a cooled wall element whose refractory lining is continuous but not homogeneous because it is constituted alternately by a row of refractory bricks and a layer of refractory material.

While such a furnace wall element constitutes an improvement over conventional furnace walls that are not cooled, it still presents many disadvantages. It is always difficult to bond a refractory material to the surface of a cooling block and, for the above-described wall element, it is necessary to tamp layers of refractory material between the bricks while the same are encased in the block. There is always a risk of failure of the bricks if the refractory layer is damaged, either due to differences in the expansion coefficients or to selective wear. Repairs take relatively long since it is necessary to remove the refractory material, pull out the bricks, insert new bricks into the recessed portions of the block and then tamp or cast the refractory material again between the bricks.

It is one of the primary objects of this invention to provide a furnace wall element comprised of a metallic cooling block and a refractory lining solidly anchored thereto.

It is a more particular object of the invention to provide an element of this type wherein the refractory lining may be readily and rapidly removed and replaced.

With these objects in view, the present invention provides a furnace wall element comprising a metallic block having an internal face and defining a cooling circuit in the interior thereof, the metallic block carrying anchoring lugs projecting from the internal face. Each anchoring lug consists of a foot portion and a retaining portion, the retaining portion being constituted by an enlarged end of the foot portion opposite the internal face. A lining of refractory bricks is anchored to the internal face of the metallic block, each refractory brick having a face adjacent the internal face of the metallic block. The face of each refractory brick defines a recessed portion of a cross section matching that of a corresponding one of the anchoring lugs.

Water or any other suitable cooling medium may be passed through the cooling circuit to provide a metallic cooling block and each of the adjoining refractory bricks lining the internal face of the block is solidly anchored thereto. Cooling the bricks tends to reduce the speed of wear but increases the risk of failure but this is avoided by anchoring the bricks to the block. In this way, a furnace wall element with a very long lasting refractory lining is obtained. Furthermore, if the lining has to be repaired, this may be done very quickly.

The above and other objects, advantages and features of this invention will become more apparent from the following detailed description of certain now preferred embodiments thereof, taken in conjunction with the accompanying drawing wherein FIG. 1 is a sectional view of one embodiment of a furnace wall element according to the invention;

Figure 1:
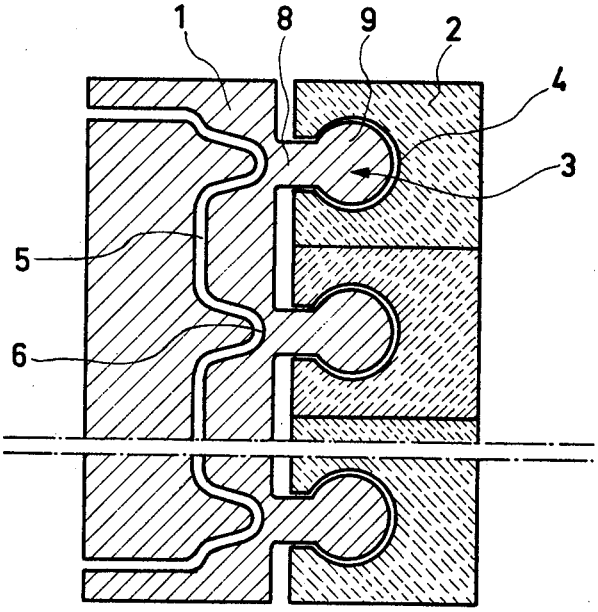
Figure 2:
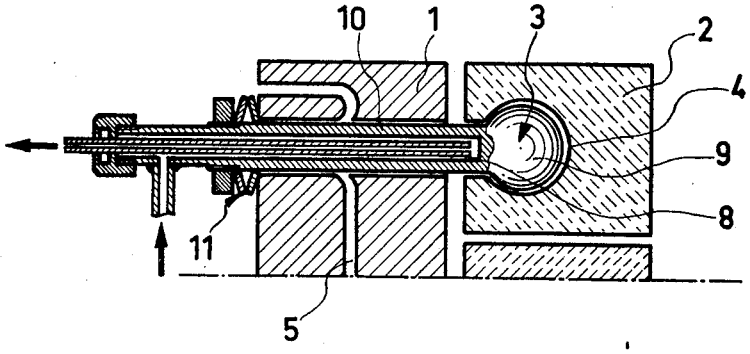
FIG. 2 is a like partial view of another embodiment.
Figure 4:
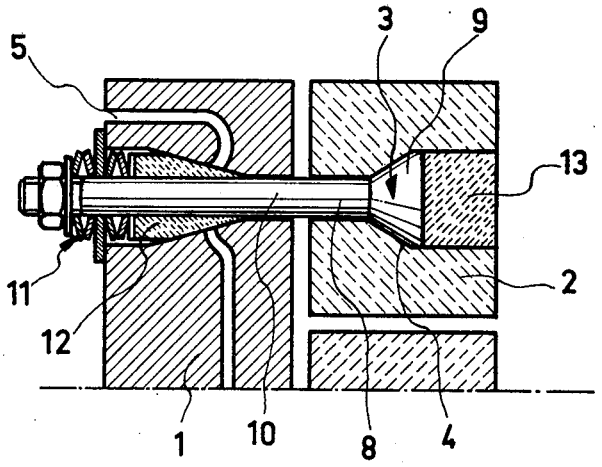
FIG. 4 is a view similar to that of FIG. 2 and showing a modification thereof.

Referring now to the drawing wherein like reference numerals designate like parts operating in a like manner in all figures, FIGS. 1, 2 and 4 show a furnace wall element comprising metallic block 1 having an internal face and defining cooling circuit 5 in the interior thereof for the circulation of water or a like cooling medium. This block could be a simple water box but is preferably a casting of steel or copper enclosing a cooling medium duct. The metallic block carries anchoring lugs 3 projecting from the internal face. Each anchoring lug consists of foot portion 8 and retaining portion 9, the retaining portion being constituted by an enlarged end of the foot portion opposite the internal face. In the embodiment of FIG. 1, the anchoring lugs are integral with the internal face of the metallic block and cooling circuit 5 has loops 6 in alignment with the anchoring lugs whereby the lugs are cooled by the cooling circuit.

The furnace wall element further comprises a lining of refractory bricks 2, each refractory brick having a face adjacent the internal face of the metallic block. The face of each refractory brick defines recessed portion 4 of a cross section matching that of a corresponding one of the anchoring lugs. In this manner and as illustrated, each refractory brick is thus retained on the internal face of the metallic block to form thereon a continuous lining of bricks solidly anchored to the block.

Figure 3:
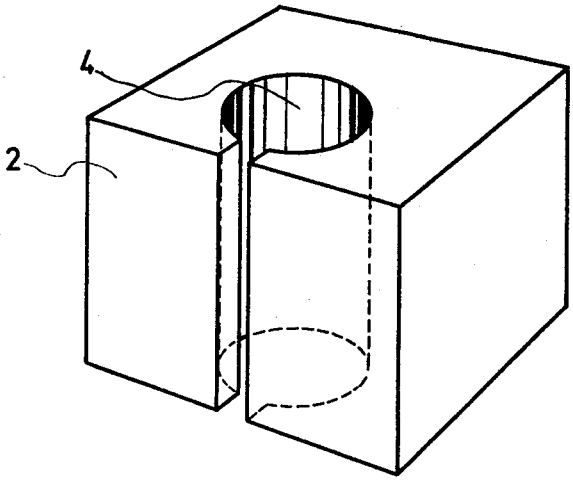
FIG. 3 is a perspective view of a refractory brick usable in either embodiment.

Retaining portions 9 of the anchoring lugs may be more or less hemispherical, as in the embodiments of FIGS. 1 and 2, or frusto-conical, as in the embodiment of FIG. 4. The foot portions of the lugs may be rail or T-shaped and the retaining portions may be symmetrical with respect to the foot portions, as illustrated, or they may be assymetrical. As a matter of fact, the retaining portions may have any suitable shape designed to fit into the recessed portions of the bricks for anchoring the bricks to the block, as long as they have an enlarged transverse dimension with respect to the foot portions. Preferably, the recessed portions will be shaped to avoid sharp angles which could give rise to fissures in the refractory. The recessed portion 4 may extend along the entire length of the brick face, as shown in FIG. 3, or only along a part of the brick face. The anchoring lugs may occupy a major part of the recessed portions of the brick or only a part thereof.

The integral metallic block 1 of FIG. 1 may be obtained by molding or machining and loops 6 of cooling circuit 5 extend towards anchoring lugs 3 for effective cooling of the lugs. When the furnace is heated, the refractory bricks will press against the internal face of the metallic block to provide good heat transfer between the block and the bricks.

In repairing the lining, it is necessary only to glide the brick of FIG. 3 transversely along anchoring lugs 3 to remove the same and, similarly, to mount new bricks by gliding them on the lugs in the reverse direction.

In the embodiments of FIGS. 2 and 4, the foot portion of each anchoring lug is constituted by metallic tie rod 10, preferably of steel. Bores pass through metallic block 1 from the external to the internal face and the tie rods pass through respective ones of the bores. One of the tie rod ends is resiliently affixed to the external face of the metallic block. In the illustrated embodiments, the one tie rod end is threaded and a nut engages the threaded tie rod end, resilient washer means 11 being placed between the nut and the external face of the metallic block for resiliently affixing the one tie rod end to the external face. The bores pass through the metallic block in zones not traversing the cooling circuit and the other tie rod end projects beyond the internal face of the metallic block. Retaining portion 9 is carried by the other tie rod end.

In the embodiments of FIGS. 2 and 4, the lining may be repaired simply by unscrewing the nut and thus making it possible to remove the tie rods with the worn bricks from the bores in the metallic block. A new brick-tie rod assembly is then mounted on the block and affixed thereto by tightening the nut on the outer end of the tie rod.

The resilient mounting of the bricks on the block makes it possible to control the spacing between the bricks and the internal block surface. This makes it possible to regulate the heat transfer between bricks and metal block while avoiding the risk of breakage of the bricks. This further increases the life of the bricks.

The metallic tie rod must be cooled, which may be done simply by contact of the tie rod with the cooled metallic block. However, it is preferred to provide a cooling circuit in the tie rod or means for improving the thermal contact between tie rod and metallic block.

In the embodiment of FIG. 2, tie rod 10 defines a cooling circuit constituted by two concentrically arranged tubes forming the tie rod for circulating a cooling liquid within the tubes. As shown, an inlet in the outer tube delivers the liquid for circulation through the tie rod and the inner tube projects beyond the outer tube to provide an outlet for the spent liquid.

In the embodiment of FIG. 4, conical steel joint 12 is positioned in the bore in the metallic block and tie rod 10 is surrounded by the joint and held therein with slight friction whereby good thermal contact is established between the tie rod and the metallic block.

Refractory bricks 2, such as shown in FIG. 3, may be used in the embodiments of FIGS. 1 and 2. These are conventional refractory bricks used in metallurgical furnaces, usually of magnesia, but they have recessed portion 4 for receiving anchoring lugs 3. While recessed portion has been illustrated as extending along the entire length of brick 2, it may extend only along a part of the brick.

Figure 5:
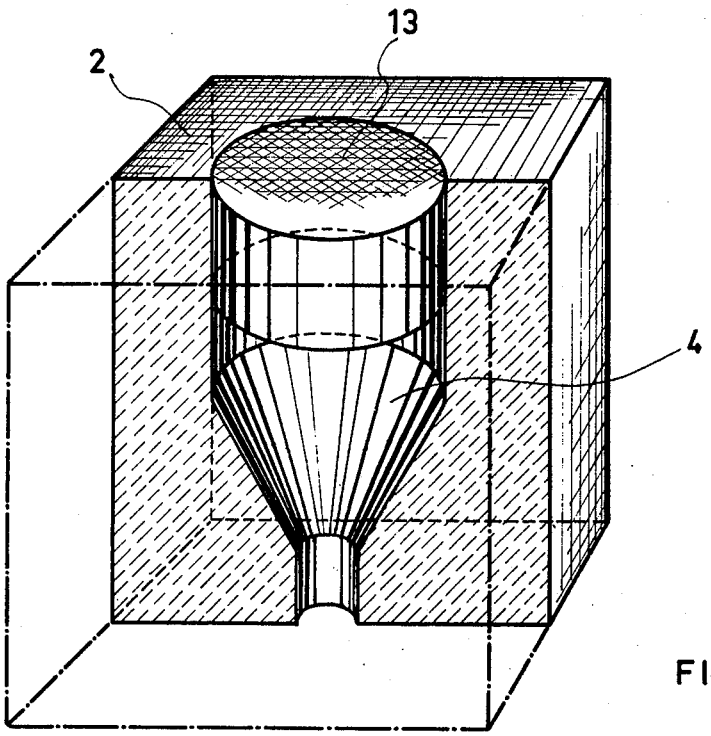
FIG. 5 is a perspective view of a brick usable in the embodiment of FIG. 4.

Contrary to the recessed portion of the refractory brick of FIG. 3, which extends the length of the brick, recessed portion 4 of brick 2 of the embodiment of FIGS. 4 and 5 is machined into the brick perpendicularly to the face of the brick. In this embodiment, a bore extends in the refractory brick from the recessed portion to a face of the brick opposite to the face adjacent the internal face of metallic block 1 and plug 13 of refractory concrete is cast in the bore and flush with the opposite face to make the opposite brick face plane. The inner face of the plug delimits the recessed portion and contacts retaining portion 9 of the anchoring lug. This embodiment avoids re-entrant angles in the machining of the bricks, which could constitute starting points for fissures. Such bricks may be used not only with the tie rods as anchoring lugs but also with anchoring lugs integral with the metallic block, provided that the recessed brick portion, as delimited by plug 13, opens onto a face perpendicular to the face adjacent the anchoring lug.

The furnace wall elements hereinabove described and herein illustrated are of particular usefulness in the furnace zones above the metal bath in an electric arc furnace for refining steel. However, they may be used in any type of metallurgical surface in any wall zone when conventional refractory linings wear rapidly. While specific embodiments have been described, many variations and modifications will occur to those skilled in the art without departing from the spirit and scope of the invention as defined in the appended claims.

What is claimed is:

1. A furnace wall element comprising 1. a metallic block having an internal face and defining a cooling circuit in the interior thereof, the metallic block carrying anchoring lugs projecting from the internal face, each anchoring lug consisting of a foot portion and a retaining portion, the retaining portion being constituted by an enlarged end of the foot portion opposite the internal face, and
2. a lining of refractory bricks, each refractory brick having a face adjacent the internal face of the metallic block, the face of each refractory brick defining a recessed portion of a cross section matching that of a corresponding one of the anchoring lugs.

2. The furnace wall element of claim 1, wherein the recessed portion extends along the entire length of the brick face.

3. The furnace wall element of claim 1, wherein the recessed portion extends along a part of the brick face.

4. The furnace wall element of claim 3, wherein a bore in the refractory brick extends from the recessed portion to a face of the brick opposite to the face adjacent the internal face of the metallic block, and further comprising a plug of refractory concrete cast in the bore and flush with the opposite face to make the opposite brick face plane.

5. The furnace wall element of claim 1, wherein the anchoring lug occupies only a part of the recessed portion.

6. The furnace wall element of claim 1, wherein the anchoring lugs are integral with the internal face of the metallic block.

7. The furnace wall element of claim 6, wherein the cooling circuit has loops in alignment with the anchoring lugs whereby the lugs are cooled by the cooling circuit.

8. The furnace wall element of claim 1, wherein the metallic block has an external face opposite to the internal face and bores passing from the external to the internal face, the foot portion of each of the anchoring lugs being constituted by a metallic tie rod passing through a respective one of the bores and having two ends, and further comprising means for resiliently affixing one of the tie rod ends to the external face of the metallic block, the other tie rod end projecting beyond the internal face of the metallic block, and the retaining portion being carried by the other tie rod end.

9. The furnace wall element of claim 8, wherein each tie rod defines a cooling circuit constituted by two concentrically arranged tubes for circulating a cooling liquid within the tubes.

10. The furnace wall element of claim 8, further comprising a conical steel joint positioned in the bore, the tie rod being surrounded by the joint and held herein with slight friction whereby good thermal contact is established between the tie rod and the metallic block.

11. The furnace wall element of claim 8, wherein the one tie rod end is threaded and further comprising a nut engaging the threaded tie rod end and resilient washer means between the nut and the external face of the metallic block for resiliently affixing the one tie rod end to the external face.

* * * * *